US005224874A

United States Patent [19]

Sell

[11] Patent Number: 5,224,874

[45] Date of Patent: Jul. 6, 1993

[54] CONNECTOR PLUG

[75] Inventor: Edward D. Sell, Iola, Kans.

[73] Assignee: Tramec Corporation, Iola, Kans.

[21] Appl. No.: 973,292

[22] Filed: Nov. 9, 1992

[51] Int. Cl.[5] ..... H01R 13/56

[52] U.S. Cl. ..... 439/448; 29/883; 439/736

[58] Field of Search ..... 29/874, 883; 269/230, 269/272.11, 276; 439/448, 736, 816, 819, 823, 839, 851, 932, 35

[56] References Cited

U.S. PATENT DOCUMENTS

| | | | |
|---|---|---|---|
| 2,000,318 | 5/1935 | Cannon | 173/328 |
| 2,991,440 | 7/1961 | Kulka | 339/17 |
| 3,007,131 | 10/1961 | Dahlgrenl et al. | 339/198 |
| 3,197,730 | 7/1965 | Hargett | 339/102 |
| 3,199,060 | 8/1965 | Marasco | 439/736 X |
| 3,375,481 | 3/1968 | Parnell | 339/94 |
| 4,005,922 | 2/1977 | Burkhart | 339/59 |
| 4,017,136 | 4/1977 | Sasgen | 339/28 |
| 4,053,201 | 10/1977 | Grappe | 339/218 |
| 4,106,834 | 8/1978 | Horowitz | 339/44 |
| 4,214,803 | 7/1980 | McKee et al. | 339/103 |
| 4,335,932 | 6/1982 | Herrmann, Jr. | 339/218 |
| 4,433,206 | 2/1984 | Lewis | 174/356 |
| 4,708,663 | 11/1987 | Eckart | 439/469 |
| 4,909,745 | 3/1990 | Hayashi | 439/76 |

FOREIGN PATENT DOCUMENTS

| | | | |
|---|---|---|---|
| 528037 | 1/1957 | Belgium | 439/736 |
| 2094569 | 9/1982 | United Kingdom | 439/736 |

OTHER PUBLICATIONS

Pollak—Coiled Assemblies—Standard 7-Way Coiled Assemblies p. 16.

Phillips 7-Pole Electrical Plugs p. 13.

Phillips Permacoil Coiled Electrical Assemblies p. 11.

7-Way Plug Assemblies p. 2.

Stallion vs The Beast p. 11.

7-Way Plug Inserts & Components p. 24.

*Primary Examiner*—Eugene F. Desmond

*Attorney, Agent, or Firm*—Dowell & Dowell

[57] ABSTRACT

A female connector plug especially for tractor-trailer interconnection has a plurality of wires permanently connected to split terminals having spring ring retainers and with shrink tubing casings encapsulated within a resilient elastomeric body which may have a pistol grip configuration.

7 Claims, 2 Drawing Sheets

CONNECTOR PLUG

BACKGROUND OF THE INVENTION

FIELD OF THE INVENTION

This invention relates to electrical connectors and, more particularly, to a plug used to interconnect the cable between a tractor and trailer.

HISTORY OF THE RELATED ART

When a tractor hooks onto a trailer, electrical interconnection becomes necessary. This interconnection is subject to vibrational movement and to the corrosive forces of weathering.

The vibrational movement tends to loosen the electrical connection at the plug as well as loosening wire connections to the terminal and to cause breaking of the wires due to fatigue. In addition, corrosion occurs at the terminal and wire connections, primarily at the female terminal in the plug. Various kinds of connections, such as set screws tightened against the wire, crimping of a terminal to the wire, crimping an eyelet to the wire and attaching the terminal with screws, have been employed but each of these methods of attachment is subject to corrosion and thereby failure of the connection. Another problem has been that the weight of the connecting plug and the cable tends to separate the connection and to bend the cable immediately outside the plug, thereby causing stress, fatigue and failure of the cable at the connector.

The use of stamped split female plug terminals having inclined or offset portions to provide an interference fit with the mating terminal in the receptacle is known. Since such terminals are typically made of a copper alloy for conductivity, their functioning as spring retainers is limited. The fatigue resulting from the mating of the parts and the vibration soon result in a loose fit and degraded electrical performance. However, it is known in the art to provide an external steel spring around the terminal to improve its gripping performance.

The use of molded plugs, generally, for electrical connections is also known. However, the use of a molded plug with split terminals has not been known, so far as can be determined, because of the inherent problem of the plastic flowing within the separated portions of the terminals.

SUMMARY OF THE INVENTION

It is an object of the invention to provide a connector plug having spring reinforced split terminals and encapsulated within an elastomeric housing.

A further object is to provide a plug in which the gripping elements are housed within an elastomeric body that is resistant to corrosion and ordinary mechanical forces including vibration.

A further object of the invention is to provide a reinforced encapsulated elastomeric plug having permanently retained gripping elements permanently connected to the wires within a plug.

A further object of the invention is to provide a plug of molded plastic which is of a configuration not only to facilitate the convenience of handling but also to permit the cable to bend at a natural slope thereby enhancing cable life by reducing or removing bending stresses.

BRIEF DESCRIPTION OF THE DRAWINGS

The foregoing and following objects of the invention will become apparent from the following description in conjunction with the accompanying drawings in which.

DESCRIPTION OF THE PREFERRED EMBODIMENT

Figure 3:
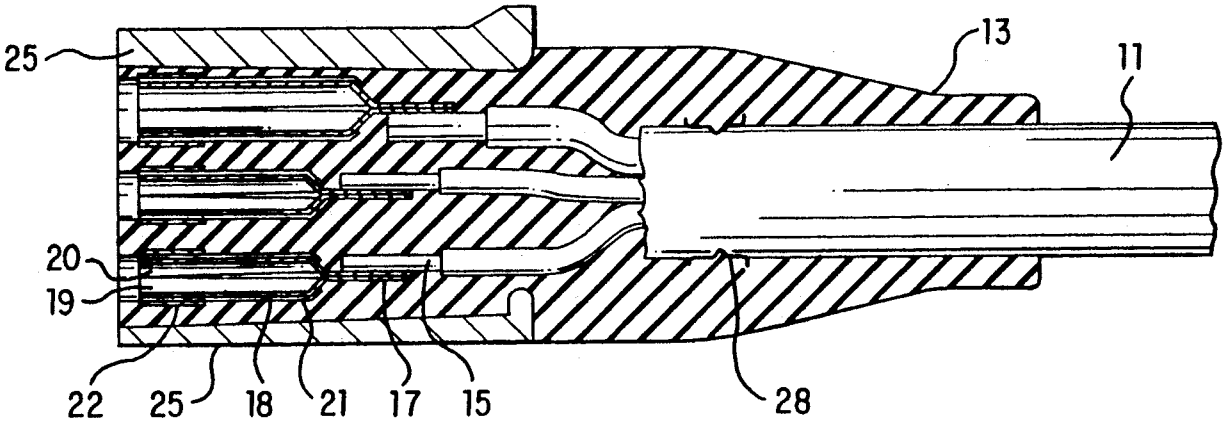
FIG. 3 is a section to an enlarged scale on the lines 3—3 of FIG. 1.
Figure 1:
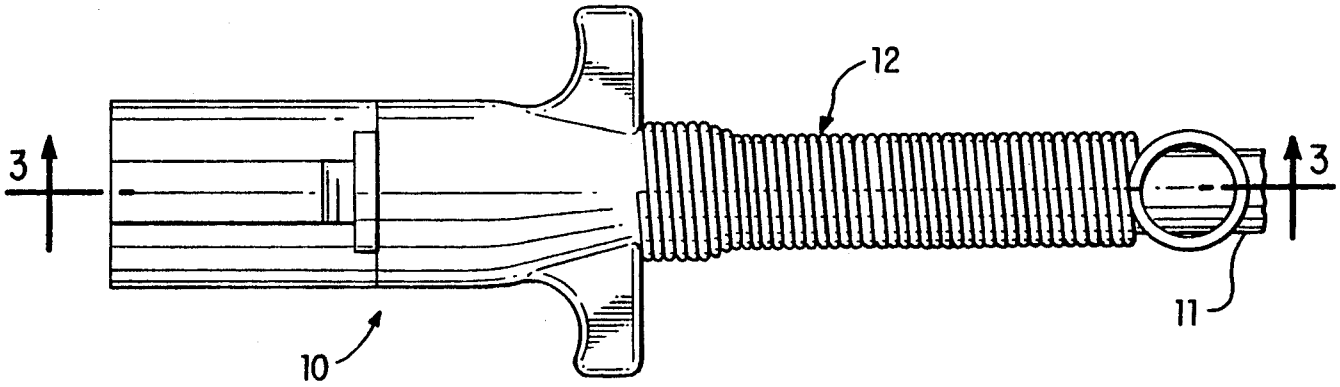
FIG. 1 is a plan view of a connector plug in accordance with the present invention.
Figure 2:
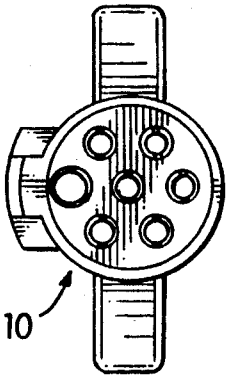
FIG. 2 is an end view of the plug.

With further reference to the drawings, a plug 10 is illustrated connected to a multi-wire cable 11 having seven wires, in this example, and having a spring guard 12 mounted over the neck 13 of the plug and extending along the cable. Each wire's stripped end 15 is connected, preferably by ultrasonic welding, to the base 17 of a split terminal 18 having sides 19, 20 connected to the base and extending therefrom in spaced relation. The split terminal is of conventional construction, of a stamped and formed copper alloy for good conductivity but of ineffectual utility as a spring. If used alone, as is commonly done, metal fatigue due to the mating of the parts soon progresses to a loose fit and degraded electrical performance.

It is understood, of course, that each terminal is provided to receive a mating pin from a male plug, of conventional structure, not shown.

In order to remedy the deficiency in spring-like quality of the terminal, a spring ring 22 of good spring material, preferably stainless steel, is placed over the outer end portion of the terminal. The diameter of the ring is selected to hold the sides 19, 20 in firm contact with a mating pin, not shown. The ring may be of any desired structure, such as a wire coil, or split coiled sheet material, that has the necessary resilient capability. Thus the continuing firm grip of the terminal on the pin does not depend solely on the terminal structure, but is enhanced by the spring ring.

In order to mold the plug around the terminals, it is necessary to avoid the intrusion of the elastomer into the inside of the terminals. It is also desirable to permit some movement of the terminals within the plug to accommodate tolerances in manufacture of the plug 10 and of the male plug. Accordingly, in the present invention, the outer end portions of the terminals as far back as the base are encased in a shrink tubing 21 of conventional nature applied by a low pressure molding process. This covers the spring ring and terminal including, particularly, the gap between the terminal sides, thereby preventing melted elastomer from flowing into the terminal during the subsequent molding process. The shrink tubing is of a nature that is not melted, but may soften, permitting its diameter to increase during the subsequent injection molding process.

During the injection molding process of the plug, the terminals are placed onto mandrels which are slightly larger in diameter than the male pins which the terminal will receive in use. When the mandrels are withdrawn after molding the terminals are then drawn closed by the spring ring, leaving a space between the outside diameter of the terminal and the inside diameter of the shrink tubing. This space permits the pressure exerted by the terminals on the male pins to be that due to the spring ring. Further, the space permits the terminals to "float" within the plug and thus accommodate tolerance in manufacture as previously mentioned.

In order to further enhance the plug a metal sleeve 25 is positioned around its outer end portion. The sleeve provides strength at this highly mechanically stressed portion of the plug, particularly at the lock tab or key area used for retention by hooking a tab on the cover of the mating receptacle, not shown, as is conventionally done, and also at the bottom of the plug where the weight of the cable forces the outside of the plug against the inside of the receptacle. The sleeve also provides durability in resisting abuse when not connected.

In addition, due to the natural resilience of the elastomer used in the molding of the plug, there is a substantial measure of stress reduction at the point of exit of the cable from the plug.

Figure 4:
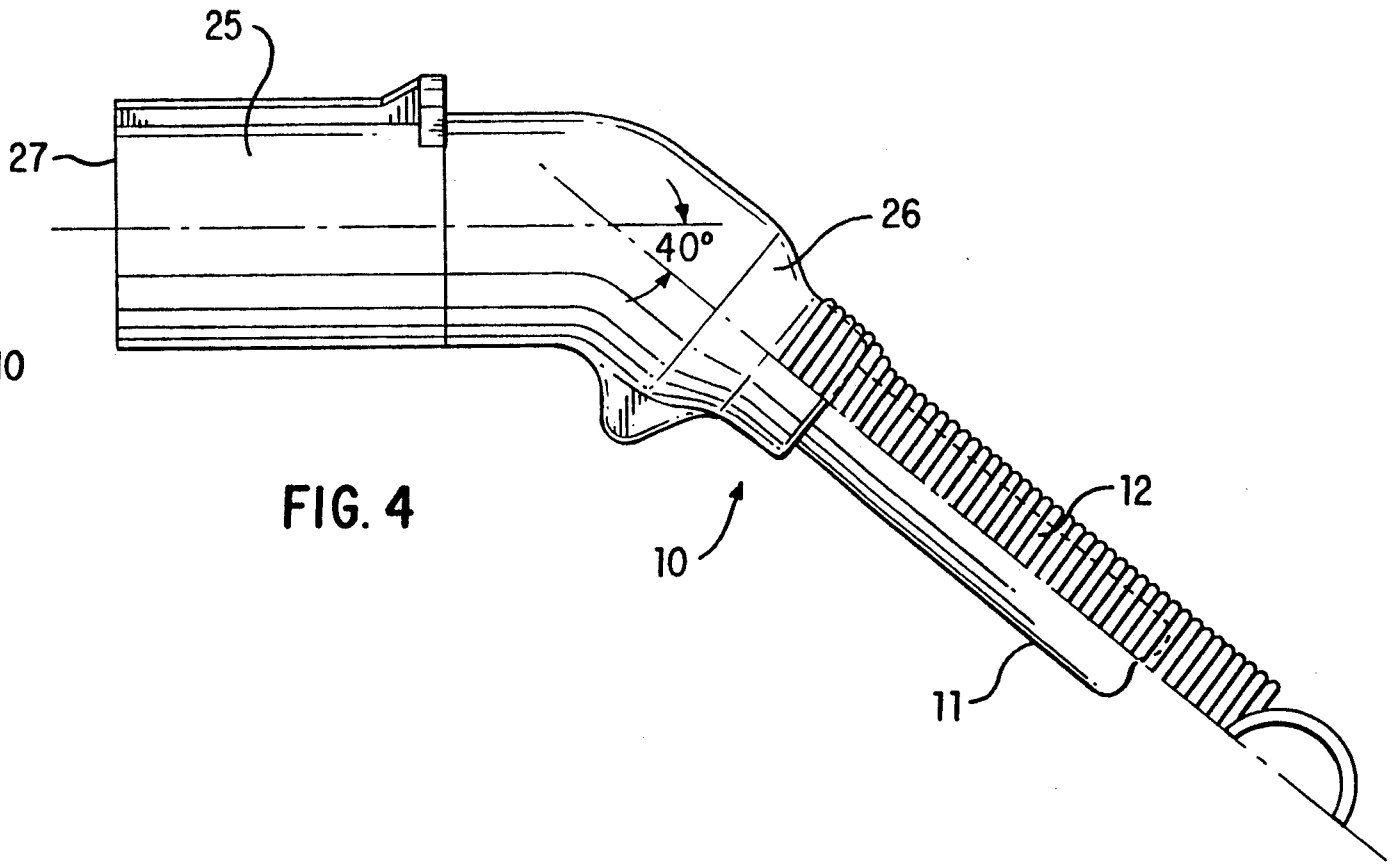
FIG. 4 is a side elevation of a modification.
Figure 5:
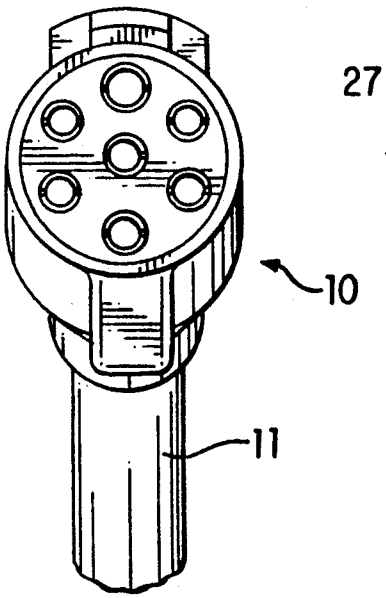
FIG. 5 is an end view of the modification of FIG. 4.

In the modification of FIGS. 4 and 5, the plug is molded with a pistol grip, having an outer end portion 27 at substantially an angle of 40° with the inner portion of the plug 26. By employing such angle, the cable is permitted to exit the assembly at its natural slope or catenary arc back to the other end of the cable, thereby enhancing cable life by avoiding bending stresses.

A conventional strain relief fitting 28, such as shown in FIG. 3, is also preferably applied to the cable 11 adjacent to the end from which the separated wires extend in both embodiments.

As a result of the present invention, the problem of corrosion of the terminals and wire connections is reduced due to the solid molding of the plug to limit the possibility of water intrusion into the assembly. Furthermore, the injection molded material provides a dielectric isolation of not only the terminals but also of the wire-terminal connection area, and provides additional strain relief to the wire-terminal connection.

Furthermore, as a result of the ultrasonic welding of the wire to the terminals, any interstitial corrosion or oxidation is avoided by combining the wire and terminal into a monolithic structure. Further, the welding of the wire and terminal also avoids the possibility of breaking the wire strands during installation or the possibility that the connections may loosen in use, as commonly occurs with other means of attachment.

I claim:

1. A female connector plug for a plurality of electric wires comprising an assembly of a yieldable split terminal having a base and of relatively high conductivity for each of said wires and for engagement with a male pin connector, each said split terminal having two or more separated longitudinally extending segments defining a space and connected at the base thereof, means connecting the base of each terminal to a wire, spring means encircling each terminal for restraining its segments against separation beyond a predetermined amount and being adapted to hold said segments in firm contact with a pin connector, a thin plastic envelope encasing each said spring means and the terminal's segments, and an elastomeric body encapsulating said electric wires and said assembly.

2. A connector plug as in claim 1, in which the connecting means is the result of ultrasonic welding.

3. A connector plug as in claim 1, and a metal sleeve surrounding an end of said body.

4. A connector plug as in claim 1, and spring guard coils around the cable leading into the elastomeric body.

5. A connector plug as in claim 1, in which the body has approximately a 40° bend where the cable enters the body.

6. A connector plug as in claim 1, in which the inside diameter of the plastic envelope exceeds the outside diameter of the segments thereby permitting limited floating movement of the terminals within the body.

7. The method of molding a female connector plug for engagement with a male plug having pins, said female connector plug having a plurality of split terminals, each terminal within an encircling spring, comprising shrinking a plastic tubing around each of the terminal-spring assemblies, placing the terminals onto mandrels having a diameter slightly larger than said pins, and molding a plug body around said tubing encased terminals, whereby when molding is completed and the mandrels are withdrawn, the split terminals are urged together by the springs, thereby leaving a space between the terminals and the tubing and permitting the terminals a slight floating movement within the body.

* * * * *